US007704161B2

(12) United States Patent
Lindner

(10) Patent No.: US 7,704,161 B2
(45) Date of Patent: Apr. 27, 2010

(54) APPARATUS FOR WEIGHTING GOLF CLUB SHAFT

(75) Inventor: Jeffrey L. Lindner, Madison, AL (US)

(73) Assignee: Balance-Certified Golf, Inc., Huntsville, AL (US)

( * ) Notice: Subject to any disclaimer, the term of this patent is extended or adjusted under 35 U.S.C. 154(b) by 0 days.

(21) Appl. No.: 12/176,243

(22) Filed: Jul. 18, 2008

(65) Prior Publication Data

US 2008/0274823 A1 Nov. 6, 2008

Related U.S. Application Data

(63) Continuation-in-part of application No. 11/726,281, filed on Mar. 21, 2007, which is a continuation-in-part of application No. 10/752,126, filed on Jan. 6, 2004, now Pat. No. 7,261,641.

(51) Int. Cl.
*A63B 53/14* (2006.01)

(52) U.S. Cl. ..... 473/297

(58) Field of Classification Search ..... 473/296–299, 473/294, 318
See application file for complete search history.

(56) References Cited

U.S. PATENT DOCUMENTS 1,658,447 A 2/1928 Lantz
1,696,462 A 12/1928 Victor
1,704,544 A 3/1929 Novak
2,051,083 A * 8/1936 Hart ..... 473/297
3,539,185 A 11/1970 Andis
4,058,312 A 11/1977 Stuff et al.
4,461,479 A 7/1984 Mitchell
4,600,195 A 7/1986 Hunter
4,674,746 A 6/1987 Benoit
4,690,407 A 9/1987 Reisner
4,869,511 A 9/1989 Spoonster, Sr.
4,887,815 A 12/1989 Hughes et al.
4,936,586 A 6/1990 Van Raemdonck
4,988,102 A 1/1991 Reisner
5,277,059 A 1/1994 Chastonay
5,364,102 A 11/1994 Appledorn
5,390,921 A 2/1995 DeRuyter
5,465,967 A * 11/1995 Boeckenhaupt ..... 473/297

(Continued)

FOREIGN PATENT DOCUMENTS

EP 0530960 A1 3/1993

(Continued)

*Primary Examiner*—Stephen L. Blau
(74) *Attorney, Agent, or Firm*—Bradley Arant Boult Cummings LLP

(57) ABSTRACT

An apparatus for selectively adding weight to the hollow shaft of a hand-held implement. One embodiment includes a deformable upper cylindrical member, a lower member, and a rod coupled between the upper and lower members. These components are sized to fit within a hollow shaft, such as a golf club shaft. The upper deformable cylinder includes a chamber at its upper end, into which an oversized insert is inserted. This causes the deformable cylinder to expand radially creating a friction fit with the inside surface of the hollow shaft. The lower member may include an annular deformable member, such as an o-ring or a sleeve, stretched over its outside surface to create a snug fit within the shaft.

11 Claims, 3 Drawing Sheets

U.S. PATENT DOCUMENTS

| | | | | |
|---|---|---|---|---|
| 5,716,289 | A | 2/1998 | Okoneski | |
| 5,722,899 | A | 3/1998 | Cheng | |
| 5,766,088 | A | 6/1998 | Severtsen | |
| 5,779,085 | A * | 7/1998 | Havlinek et al. | 220/234 |
| 5,871,140 | A | 2/1999 | McCrink | |
| 6,007,431 | A | 12/1999 | Bloom, Jr. | |
| 6,074,119 | A * | 6/2000 | Schlanger | 403/297 |
| 6,190,267 | B1 | 2/2001 | Marlowe et al. | |
| 6,364,787 | B1 | 4/2002 | Huiskamp | |
| 6,533,301 | B1 * | 3/2003 | Catania | 280/124.13 |
| 6,739,813 | B1 * | 5/2004 | Gundy et al. | 411/60.2 |
| 7,582,023 | B2 * | 9/2009 | Hung | 473/299 |
| 2003/0027658 | A1 * | 2/2003 | Li et al. | 473/318 |
| 2009/0163286 | A1 * | 6/2009 | Hung | 473/298 |

FOREIGN PATENT DOCUMENTS

| | | | |
|---|---|---|---|
| EP | 0545606 | A1 | 6/1993 |
| EP | 0377673 | B1 | 5/1997 |
| EP | 1153632 | A2 | 11/2001 |
| GB | 11118 | | 7/1901 |

* cited by examiner

APPARATUS FOR WEIGHTING GOLF CLUB SHAFT

This application is a continuation-in-part of and claims the benefit of U.S. patent application Ser. No. 11/726,281, filed Mar. 21, 2007, which in turn is a continuation in part and claims the benefit of U.S. patent application Ser. No. 10/752,126, filed Jan. 6, 2004, now U.S. Pat. No. 7,261,641.

BACKGROUND

The present invention provides an apparatus for improving the dynamic response or feel of a golf club as it strikes a golf ball during play by selectively adding weight to the upper end of the shaft. Although there are many products and prior patents relating to adjusting the swing weight, feel, or balance of a golf club, few if any of these devices are directed towards improving the dynamic response, or feedback, of the club to the golfer at ball impact. Most prior art devices are aimed more specifically at the static or quasi-static feel of the club in the golfer's hand at the initial alignment, or during the back and forward swings. Such devices usually focus on the feel of the club itself, not the feel of the shot through the club. The importance of impact and dynamic response to the golfer's game are often overlooked.

Impact is momentary, but it is at and immediately following this critical moment that the golfer feels his shot through the dynamic response of the club. As many golfers will confess, after impact one often knows where the ball is heading without having to actually see its trajectory. The golfer has only one tactile interface to the club, and that is through his hands which grasp the club's shaft on the grip. It is thus through the golfer's hands gripping the shaft that the dynamic response of the club to the golfer's stroke is communicated. This dynamic response is a result of the vibration characteristics of the club, and the golfer often perceives it simply as feel. Thus it follows that if the club's dynamic response can be increased in this specific gripping area, the golfer will have a better feel for his shot.

The present invention provides an apparatus for improving the dynamic response of the golf club by allowing a golfer to selectively adjust the weight of the club at its grip end. This action in turn enhances the feel of the club to the golfer.

SUMMARY

One embodiment of the present invention comprises a deformable cylinder sized to fit within a hollow shaft, such as that of a golf club. This cylinder includes an upper void or chamber, into which an oversized removable insert is inserted. This causes the deformable cylinder to expand against the inside of the shaft, creating a secure friction fit. This embodiment also includes a lower rigid cylinder with at least one circumferential groove on its outer wall and at least one annular deformable member, such as an o-ring or sleeve, fitted around the rigid cylinder and seated in the groove(s). The rigid cylinder, as fitted with the annular member(s), is sized to fit snugly within the shaft. The deformable cylinder is coupled to the lower rigid cylinder by a rod. These components may be constructed of different lengths or materials in order to selectively vary the amount and location of weight added to the golf club.

DESCRIPTION OF DRAWINGS

These and other features, aspects, structures, advantages, and functions are shown or inherent in, and will become better understood with regard to, the following description and accompanied drawings where.

DETAILED DESCRIPTION

The present invention relates to device for adding weight to the end of a hollow shaft for a hand-held implement such as a golf club. A golf club shaft will be referred to herein as the exemplary application for the device, but it should be understood there are many other applications for the device as well.

Figure 1:
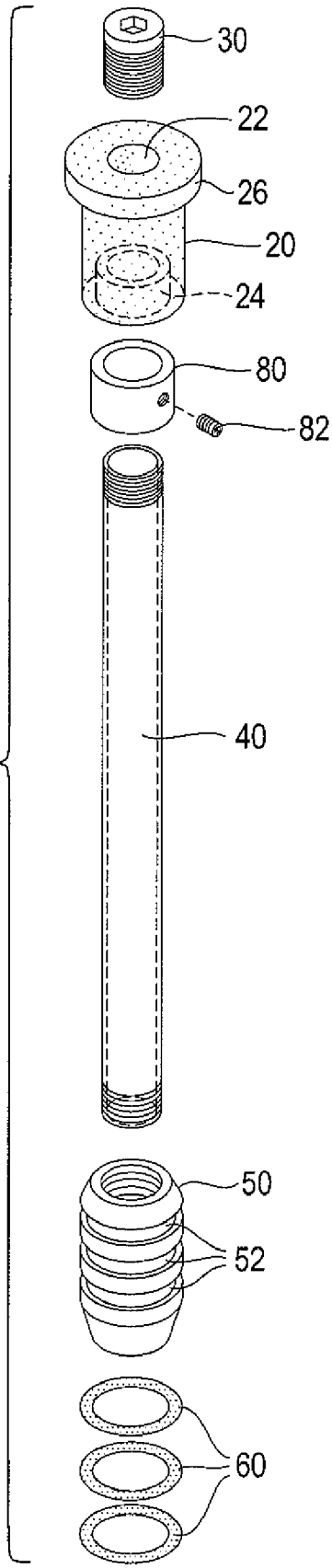
FIG. 1 is a perspective exploded view of one embodiment of the present invention.
Figure 2:
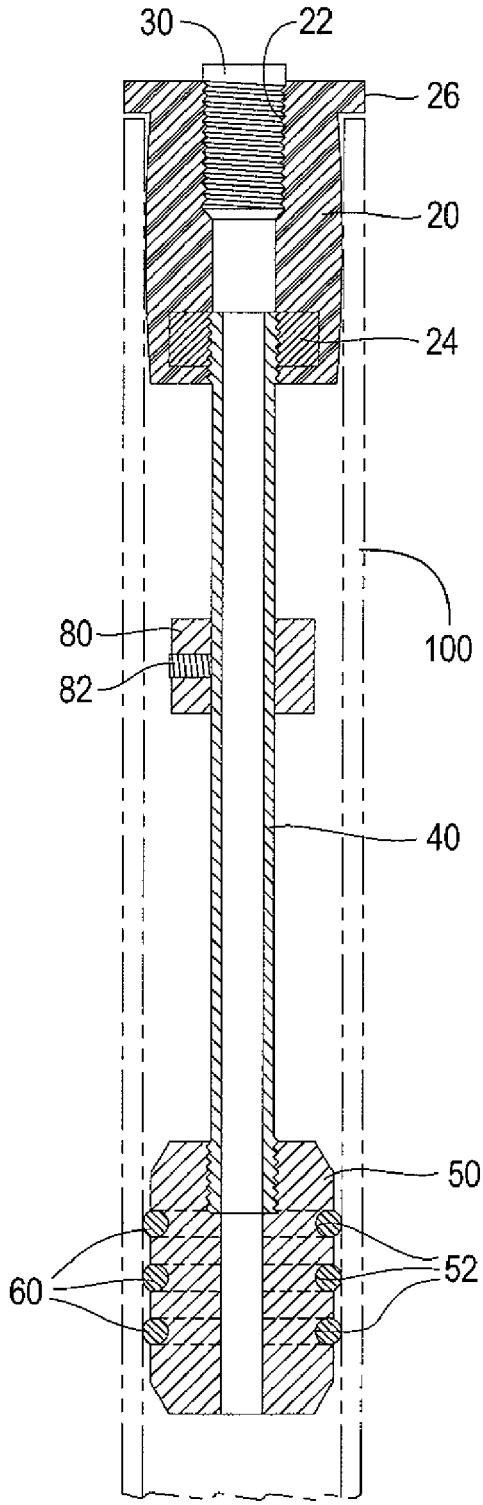
FIG. 2 is a side sectional view of the embodiment of FIG. 1 assembled and installed on a golf club shaft.

One embodiment of the present invention is illustrated in FIGS. 1-2. As shown in FIGS. 1-2, the device 10 comprises an upper cylindrical member 20 coupled to a lower member 50 by a rod 40. The upper cylindrical member is made of a deformable material, such as a polymer. The embodiment further comprises a rigid insert 30 and o-rings 60, which seat in grooves 52 in the lower member 50. The deformable cylindrical member 20 and lower member 50, with o-rings mounted, are sized to fit within the shaft 100. The deformable cylindrical member 20 includes an upper chamber 22 for receiving the rigid insert 30. The rigid insert 30 is slightly larger than the upper chamber 22, such that when it is pushed into place, it causes deformable cylindrical member to expand radially and create a secure friction fit against the inside of the shaft 100.

In a preferred embodiment, the insert 30 may be threaded and include a slot or receptacle for receiving a tool. After the insert 30 is pushed into place, the threading allows easy removal of the insert from the upper cylinder 20, which allows the device 10 to be removed from the shaft 100. The upper cylinder 20 may include a flange 26 of a diameter approximating that of the outside of the shaft 100, so that flange 26 acts as a stop when the device 10 is inserted into the shaft 100.

The rod 40 may be either removably or permanently affixed to the upper and lower members. In a preferred embodiment, portions of the upper and lower ends of the rod are threaded. The deformable cylinder 20 includes may include a lower chamber into which a threaded nut 24 is affixed and which receives the upper threaded end of the rod 50. Similarly, the lower member 50 may include a threaded chamber or bore to receive the lower threaded end of the rod 40. In an alternative embodiment, the rod 40 is press fit into either or both of the upper and lower members and, optionally, secured with an adhesive. Optionally, a weighted collar 80 may be mounted upon the rod 40 and fixed in a desired location using the set screw 82, or other similar mechanism.

The lower member 50 is generally cylindrical, but may be tapered or otherwise oblong as desired. As used herein, the term cylindrical includes an object of such an oblong shape and does not require a uniform diameter or cross section throughout its length. The lower member 50 comprises a plurality of grooves 52. In this embodiment, the grooves are shaped and sized to receive o-rings 52 and allow the o-rings to seat in the grooves, with some portion of the o-ring protruding beyond the surface of lower member 50. The o-rings are made of a deformable material, such as a polymer. Thus, the o-rings compress as the device 10 is placed within the shaft 100 and provide a snug fit between the lower member 50 and the shaft 100.

In a preferred embodiment, an axial bore extends all the way through the lower member 50, and the upper and lower chambers of the deformable cylinder 20 are formed by an axial bore through the deformable cylinder, and the rod 40 is hollow. This allows a passage for air to escape as the assembly is inserted into a shaft 100. As noted above, after this assembly is placed into the shaft, the slightly oversized rigid insert 30 is pushed into the upper chamber (or upper portion of the bore) in the deformable cylinder 20, which causes the cylinder to expand against the inside of the shaft 100, securely holding the device 10 in place.

Figure 3:
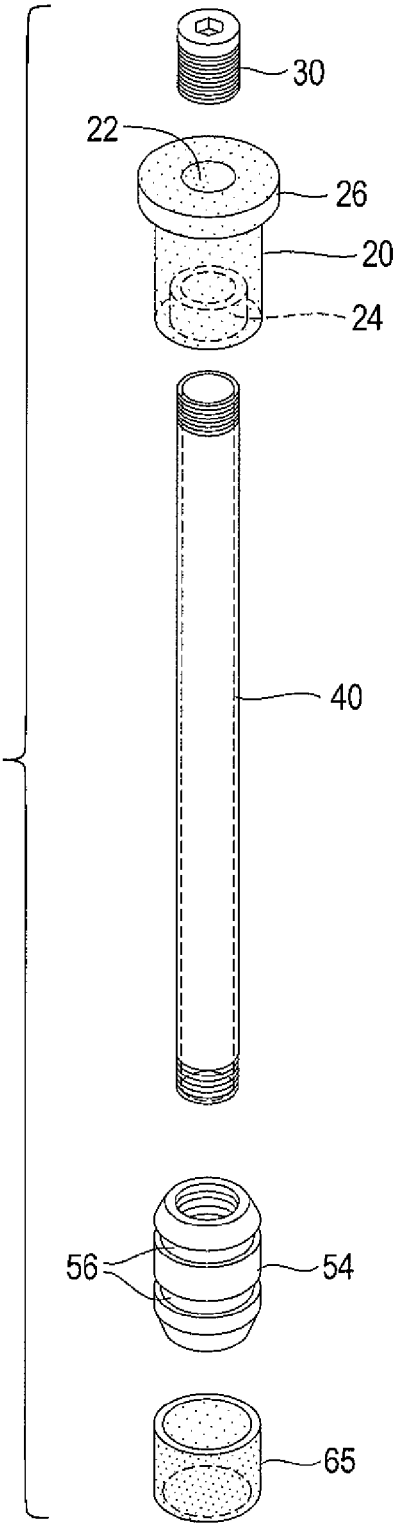
FIG. 3 is a perspective exploded view of another embodiment of the present invention.
Figure 4:
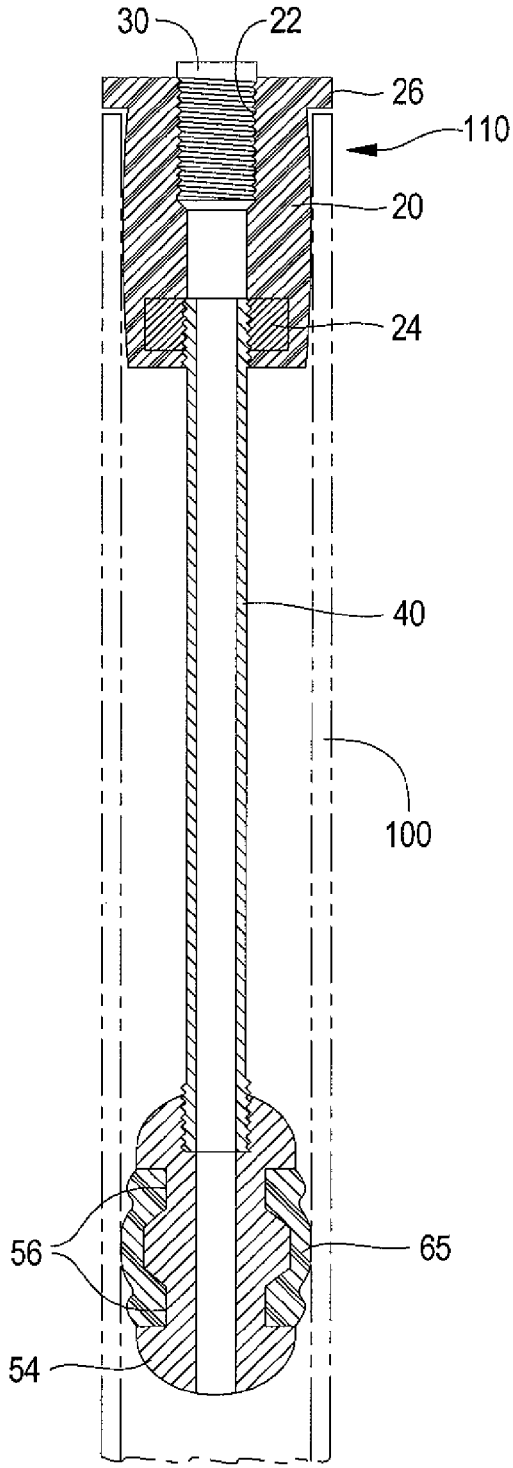
FIG. 4 is a side sectional view of the embodiment of FIG. 3 assembled and installed on a golf club shaft.

FIGS. 3-4 illustrate an alternative embodiment of the present invention. This embodiment 110 is the same as that shown in FIGS. 1-2, except for differences in the lower member and this embodiment is illustrated without the optional collar, which could be included if desired for a particular application. As shown in FIGS. 3-4, the lower member 54 includes two grooves 56. A deformable sleeve 65 is stretched over the lower member 54, with each end of the sleeve 65 seating in one of the grooves 56. The sleeve 65 is preferably made of a polymer material, and a piece of flexible tubing may be used. The sleeve 65, stretched over a mid-section of the lower member 54 between the grooves 56, thus compresses as the device 10 is placed within the shaft 100 and provides a snug fit between the lower member 54 and the shaft 100.

Devices 10 and 110 having a range of weights can easily be manufactured by making the lower cylindrical member, rod, and collar of varying lengths or of materials of varying densities (e.g., tungsten, brass, aluminum), or a combination of the two. In this way, a range of weights can be tested until a weight providing optimum feel for a given club is selected. The deformable cylinder 20 is typically made of a polymer, but other deformable materials capable of providing the desired friction fit could be used.

Figure 5:
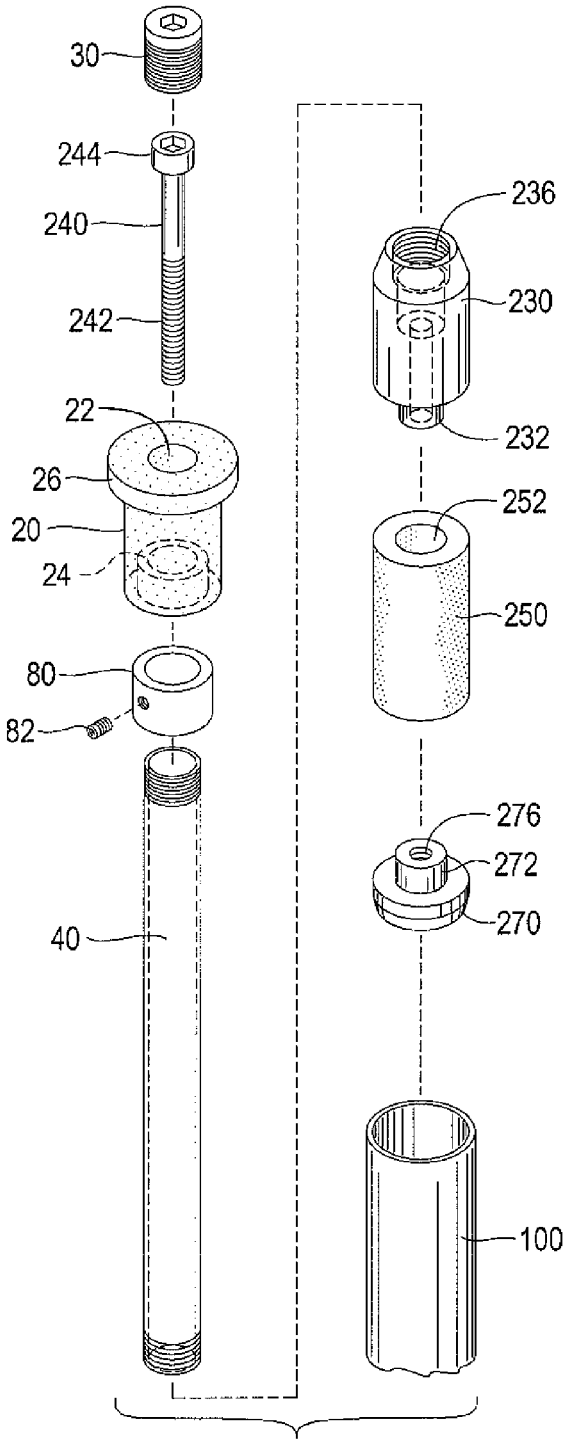
FIG. 5 is a perspective exploded view of another embodiment of the present invention.
Figure 6:
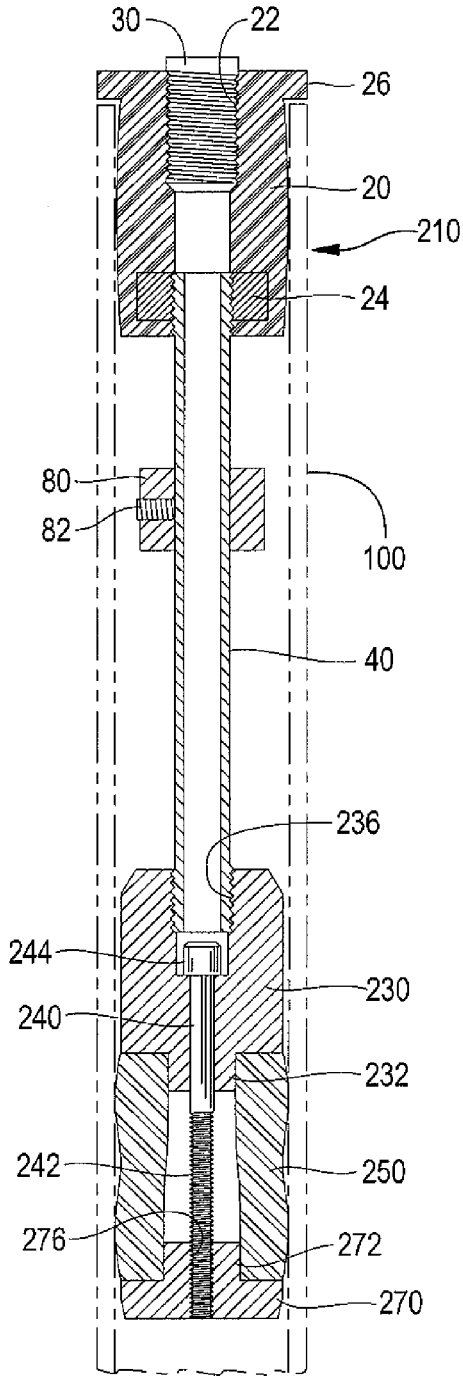
FIG. 6 is a side sectional view of the embodiment of FIG. 5 assembled and installed on a golf club shaft.

Another embodiment of the present invention is illustrated in FIGS. 5-6. As shown in FIG. 5, the device 210 includes the same upper deformable cylindrical member 20 and rod 40 as the previous embodiments, and is illustrated with the optional collar 80. However, device 210 utilizes a different structure in its lower portion. In addition to deformable cylinder 20 (optionally including flange 26 and threaded nut 24), insert 30, rod 40, the device 210 comprises a lower cylindrical member 230, a screw 240, a nut 270, and an expander ring 250. The rod 40, which is hollow in this embodiment, extends between the deformable cylindrical member 20 and the lower member 230. As described in more detail below, the screw 240 extends through the lower member 230, through the expander ring 250 and into the nut 270. When tightened, the screw 240 causes the nut 270 to be drawn towards the lower member 230, thus compressing ring 250 and causing it to expand radially. This radial expansion creates a friction fit of the device 210 within a hollow shaft 100, as shown in FIG. 6.

The lower member 230, the main body of which will generally be of a cylindrical shape sized to fit within the shaft 100, includes a first post 232 extending down from its lower surface. The first post 232 is concentric with (or coaxial with) the lower member 230. A second axial bore 236 extends through the main body of the lower member 30 and into the first post 232. The bore 236 is sized to receive the screw 240, with an enlarged portion near the upper terminus to receive the screw's cap 244 and the remainder sized to accommodate the screw's barrel 242.

The nut 270 is located below the lower member 230. The nut 270 can be of any shape that will fit within the shaft 100 and accommodate the expansion ring, but is preferably round and slightly smaller than the internal diameter of the shaft 100. The nut 270 includes a second post 272 extending from its upper surface. The second post 272 is concentric with (or coaxial with) the nut 270. A second axial bore 276 extends through the second post 272 and, typically, into the main body of the nut 270. The second axial bore 276 is threaded complementary to the threaded portion of the barrel 242 of screw 240.

The expander ring 250 fits between the lower member 230 and the nut 270. Specifically, the expander ring 250 is annular or hollow, with its inner void being referred to as a third axial bore 252. The third axial bore 252 is sized so that the expander ring 250 fits snugly onto the first post 232 and the second post 272. In a preferred embodiment, as shown in FIG. 6, the diameter of the second post 272 is larger than that of the first post 232 and is sufficient to force the expander ring 250 to expand radially when the ring 250 is pushed onto the second post 272. This expansion tends to prevent the nut 270 from rotating as the screw is turned during installation and removal of the device 210 from the shaft 100.

The lower member 230, the nut 270, the hollow rod 40, and the collar 80 may be made from any suitably durable and rigid material, as described above. Similarly, the expansion ring 250 may be made from any deformable material with good durability, such as a polymer, including a polymer reinforced with a non-polymeric material, such as strands of nylon, to add strength and control the deformation characteristic.

In one embodiment, the inner diameter of the hollow rod 40 is smaller than the cap 244 of the screw 240. Thus, the screw 240 is seated into the enlarged portion of the second bore 236 before the hollow rod 40 is fixed between the upper and lower members. Thus, once the rod 40 is in place, the screw 240 cannot fall out. In practice, the upper and lower members may be removably or permanently affixed to the rod 40, as may be desired for a given application. The ring 250 is mounted on the first and second posts 232 and 272, as described above, and the nut 270 is partially threaded onto the screw 240. This assembly is inserted into a hollow shaft. Then, using an elongate tool extending through the deformable cylinder and the hollow rod, the screw is then tightened into the nut, causing the expansion ring 250 to expand radially and creating a friction fit between the device 200 and the shaft 100.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A device for selectively weighting the handle end of a hand-held implement with a hollow shaft, comprising:

a deformable cylinder sized to fit within said shaft, comprising an upper chamber;

a removable insert for insertion into said upper chamber, said insert larger in diameter than said upper chamber, thereby causing said deformable cylinder to expand against the inside of said shaft as insert is inserted into said upper chamber;

a lower rigid cylinder comprising at least one circumferential groove on the outer wall thereof and at least one annular deformable member fitted around said rigid cylinder and seated in said at least one groove, wherein said rigid cylinder fitted with said annular member is sized to fit snugly within said shaft; and a rod with an upper end and a lower end, the upper end coupled to said deformable cylinder and said lower end coupled to said rigid cylinder.

2. The device of claim 1, wherein said deformable cylinder comprises a flange extending from the upper surface of said cylinder, said flange being larger in diameter than the inside diameter of said hollow shaft.

3. The device of claim 1, wherein said deformable cylinder comprises a lower chamber, and the upper end of said rod is coupled to said lower chamber.

4. The device of claim 3, wherein said deformable cylinder comprises a threaded nut affixed in said lower chamber and the upper end of said rod is threaded complementary to said nut, and said rod is coupled to said deformable cylinder by screwing the upper end of the rod into said nut.

5. The device of claim 3, wherein said upper chamber joins said lower chamber forming an axial bore extending through said cylinder.

6. The device of claim 5, wherein said rod is hollow and said lower cylinder comprises a bore therethrough, coaxial with said hollow rod and the bore through said deformable cylinder.

7. The device of claim 1, wherein said removable insert is threaded.

8. The device of claim 1, wherein said lower rigid member comprises two grooves and said annular deformable member is a sleeve, said sleeve extending between said grooves with either end thereof seated in one of said grooves.

9. The device of claim 1, wherein said annular deformable member is an o-ring.

10. The device of claim 9, further comprising a plurality of said grooves and a plurality of o-rings, each of which is seated in a groove.

11. The device of claim 1, further comprising a collar mounted on said rod.

* * * * *